US009328747B2

(12) United States Patent
Grenier

(10) Patent No.: US 9,328,747 B2
(45) Date of Patent: May 3, 2016

(54) SERVO ACTUATOR LOAD VECTOR GENERATING SYSTEM

(71) Applicant: MTS Systems Corporation, Eden Prairie, MN (US)

(72) Inventor: Glen Charles Grenier, Ray, MI (US)

(73) Assignee: MTS Systems Corporation, Eden Prairie, MN (US)

( * ) Notice: Subject to any disclaimer, the term of this patent is extended or adjusted under 35 U.S.C. 154(b) by 358 days.

(21) Appl. No.: 13/843,902

(22) Filed: Mar. 15, 2013

(65) Prior Publication Data

US 2014/0260226 A1 Sep. 18, 2014

(51) Int. Cl.
*F15B 11/00* (2006.01)

(52) U.S. Cl.
CPC ..... *F15B 11/006* (2013.01); *F15B 2211/30575* (2013.01); *F15B 2211/7054* (2013.01); *F15B 2211/76* (2013.01); *F15B 2211/761* (2013.01)

(58) Field of Classification Search
CPC ..... F15B 11/006; F15B 13/0842
USPC ..... 60/470
See application file for complete search history.

(56) References Cited

U.S. PATENT DOCUMENTS 3,954,046 A * 5/1976 Stillhard ..... 91/446
5,947,140 A * 9/1999 Aardema et al. ..... 91/454
5,960,695 A * 10/1999 Aardema ..... F15B 11/006 137/596.17
6,354,185 B1 * 3/2002 Sturman ..... F15B 11/006 91/454
6,357,276 B1 * 3/2002 Koehler ..... F15B 11/006 73/1.01
6,655,136 B2 * 12/2003 Holt et al. ..... 60/469
6,718,759 B1 * 4/2004 Tabor ..... 60/460
8,683,793 B2 * 4/2014 Bergstrom ..... E02F 9/2217 60/414
2003/0121408 A1 * 7/2003 Linerode et al. ..... 91/433
2007/0044465 A1 3/2007 Zhang et al.
2007/0227136 A1 10/2007 Pfaff
2010/0024410 A1 * 2/2010 Brickner ..... 60/413
2014/0123633 A1 5/2014 Rosth

FOREIGN PATENT DOCUMENTS

WO 20120161628 A1 11/2012

OTHER PUBLICATIONS

International Search Report and Written Opinion dated Jul. 3, 2014 for corresponding International Application No. PCT/US2014/024253, filed on Mar. 12, 2014.

* cited by examiner

*Primary Examiner* — Thomas E Lazo
(74) *Attorney, Agent, or Firm* — Steven M. Koehler; Westman, Champlin & Koehler, P.A.

(57) ABSTRACT

A servo actuator system and method of operating the same includes a dual acting actuator comprising an actuator body and a movable member movable in the actuator body to define a first and second chamber on each side of the movable member. A first port is fluidly coupled to the first chamber and a second port is fluidly coupled to the second chamber. A fluid pump having a return is provided. A proportional valve assembly is fluidly coupled to the fluid pump, return and the first and second ports. The proportional valve assembly includes a plurality of metering orifices. A controller is operably coupled to the proportional valve assembly to control the plurality of metering orifices to generate a load vector having magnitude and direction and wherein an actual position of a movable member in an actuator body is indeterminate.

13 Claims, 5 Drawing Sheets

SERVO ACTUATOR LOAD VECTOR GENERATING SYSTEM

BACKGROUND

The discussion below is merely provided for general background information and is not intended to be used as an aid in determining the scope of the claimed subject matter.

In a conventional configuration of a dual-acting servo actuator, a servo valve meters fluid from a pump to one of two ports of the dual-acting actuator, while also fluidly coupling the other port on an opposite side of a piston in the actuator to a return. In such a system, precise positioning of the piston in the actuator cylinder can be obtained. The actuator thus exhibits characteristics of applying a displacement vector, that being moving a point or object a known distance from an initial to a final position.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the background.

A servo actuator system and method of operating the same includes a dual acting actuator comprising an actuator body and a movable member movable in the actuator body to define a first and second chamber on each side of the movable member. A first port is fluidly coupled to the first chamber and a second port is fluidly coupled to the second chamber. A fluid pump having a return is provided. A servo assembly is fluidly coupled to the fluid pump, return and the first and second ports. The servo assembly includes a plurality of metering orifices. A controller is operably coupled to the servo assembly to control the plurality of metering orifices to generate a load vector (e.g. force or torque) having magnitude and direction and wherein an actual position of a movable member in an actuator body is indeterminate.

Stated another way, the controller is operably coupled to the servo assembly to operate the servo actuator system in a first state and a second state, wherein in the first state the controller controls each of the plurality of metering orifices such that fluid from the pump flows to the return and fluid transfers freely in and out of the ports with force applied to the movable member, and wherein in the second state the controller controls each of the plurality of metering orifices such that fluid pressure from the pump causes movement of the movable member in the actuator body (by applying a load, e.g. force or torque to the movable member, which in turn applies a load, force or torque) while allowing cross flow of fluid between the first and second ports.

DETAILED DESCRIPTION OF THE ILLUSTRATIVE EMBODIMENTS

Figure 1:
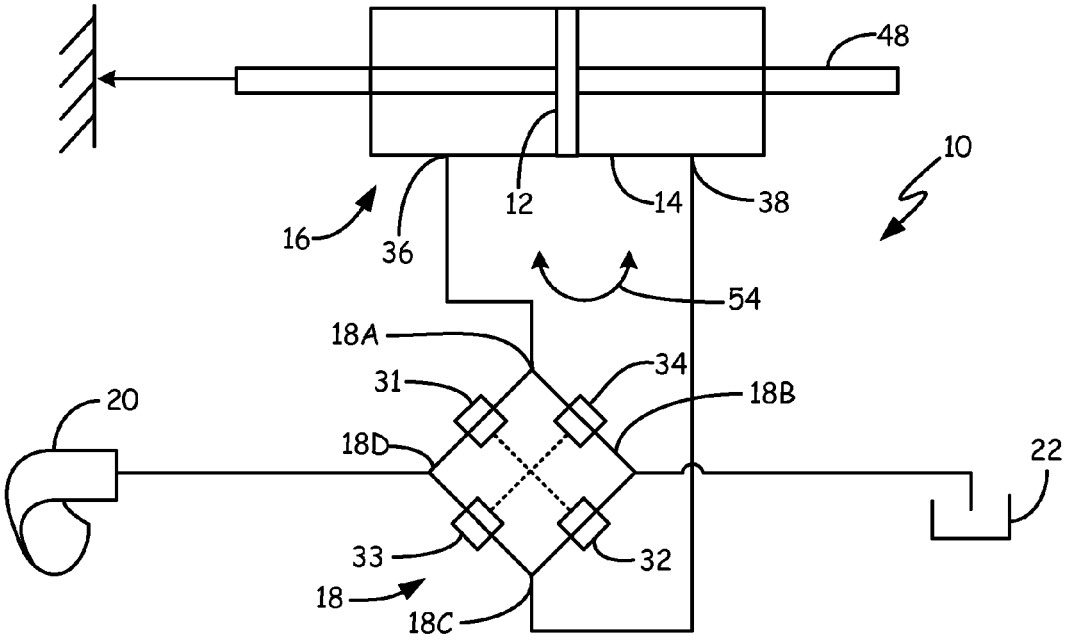
FIG. 1 is a schematic illustration of a first embodiment of a servo actuator vector generating system to generate a force vector.
Figure 2:
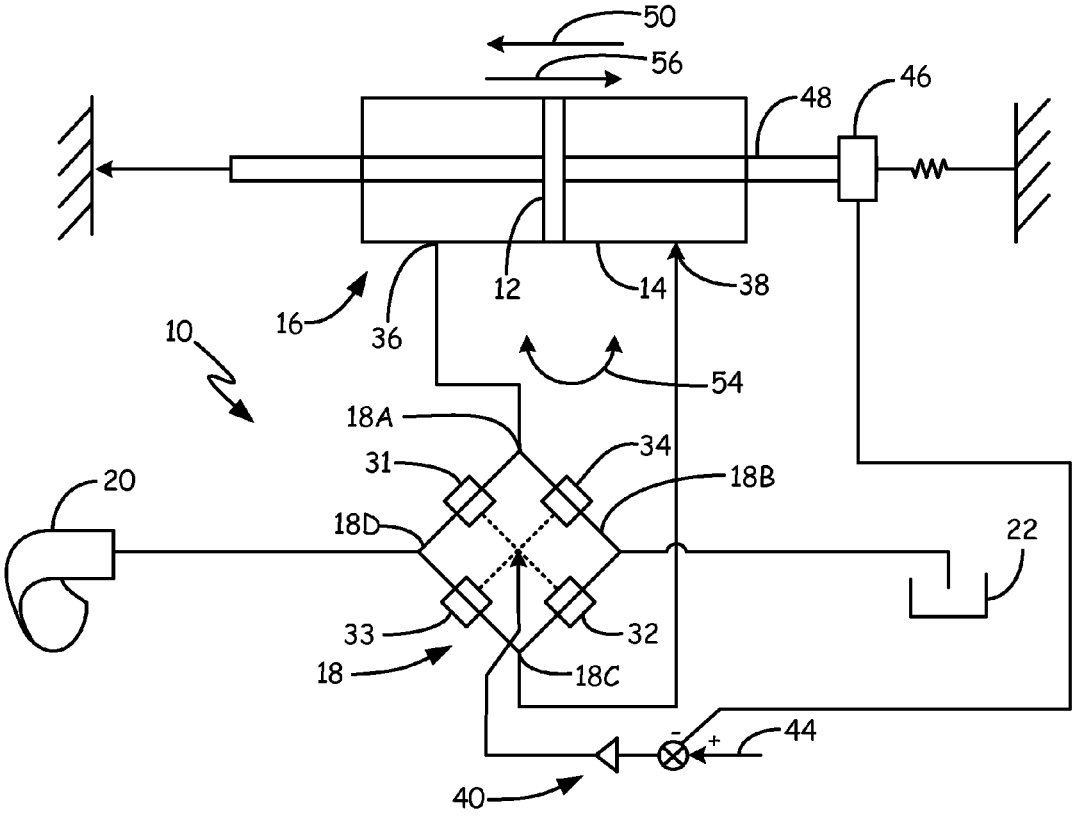
FIG. 2 is a schematic illustration of the embodiment of FIG. 1 illustrating an applied force state.
Figure 3:
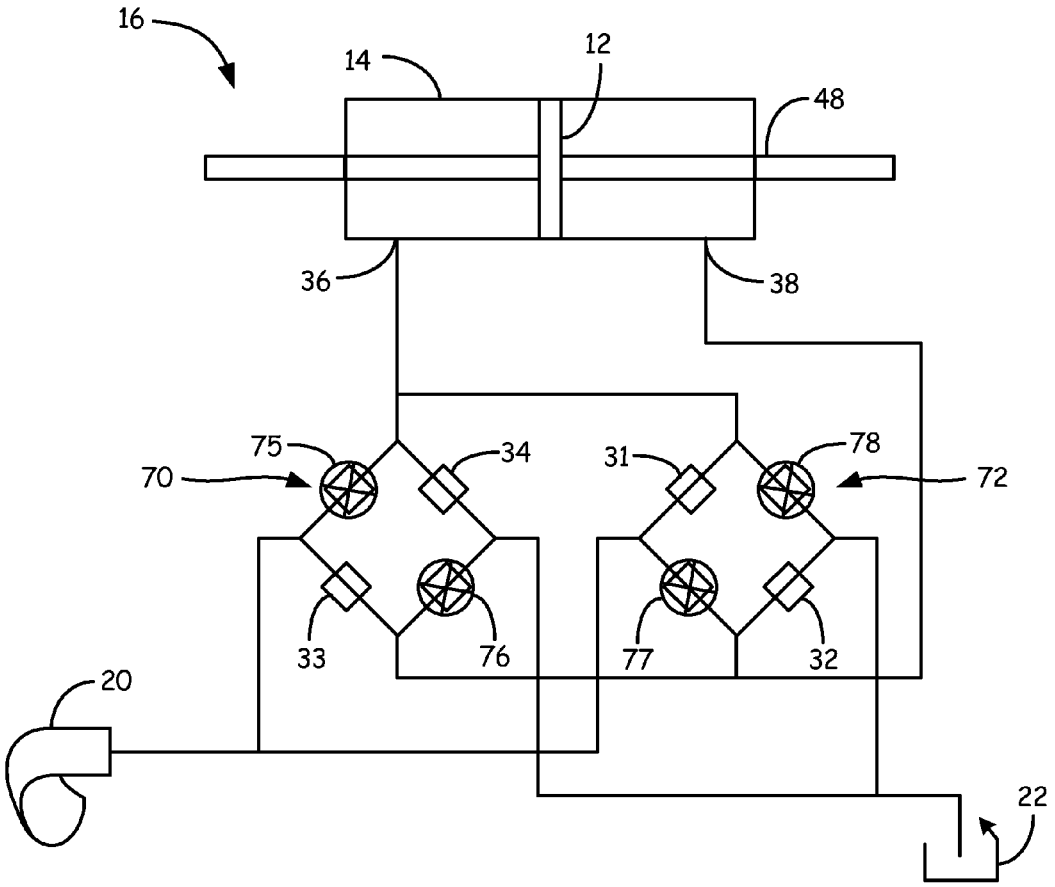
FIG. 3 is a schematic illustration of a second embodiment of a servo actuator vector generating system to generate a force vector comprising two conventional hydraulic servo valves.
Figure 7:
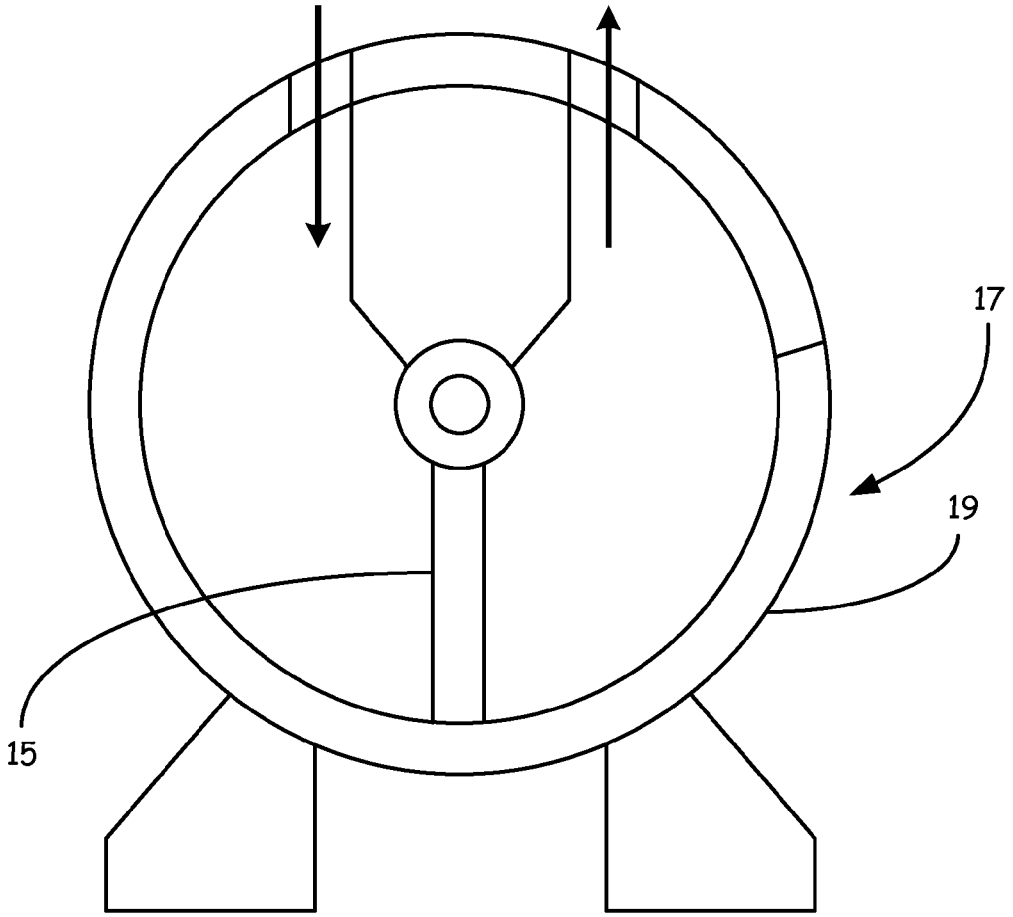
FIG. 7 is a schematic illustration of a rotary actuator.

FIGS. 1 and 2 illustrate a first embodiment of a servo actuator vector generating system 10 in two states of operation. The servo actuator vector generating system 10 generates a true vector (magnitude and direction) where the actual position of a movable member in an actuator body is indeterminate. In the embodiments of FIGS. 1-3, the system 10 includes a dual-acting actuator 16 having a piston 12 (movable member) slidable in a cylinder 14 (actuator body). Nevertheless, it should be understood that aspects of the present invention are not limited to linear actuators, but also can be used with a rotatory actuator 17 as illustrated in FIG. 7 having a vane 15 (movable member) rotable in a housing 19. Although described below in detail with respect to a linear actuator 16 to generate a force vector, it should be understood aspects of the invention are equally applicable to the rotary actuator 17 to generate a torque, which is also a vector quantity having magnitude and direction.

Referring to FIGS. 1 and 2, the servo actuator vector generating system 10 generally comprises dual acting actuator 16, a servo valve assembly 18, and a pump 20 having a return indicated at 22. Unlike in a conventional fluidic system (hereinafter specifically referred to as a hydraulic system, but it should be understood aspects of the invention can be used with a pneumatic system as well) where the servo valve selectively fluidly couples the pump to one or the other of the actuator ports, while simultaneously fluidly coupling the other port to the return (as discussed in the background), the servo valve assembly 18 comprises metering orifices that selectively constrict fluid flow therethrough so as to increase pressure on one side of the piston 12 or the other.

In the embodiment illustrated, the servo valve assembly 18 includes four metering orifices 31, 32, 33 and 34 and four ports 18A, 18B, 18C and 18D, wherein a unique pair of metering orifices is fluidly connected to each port 18A, 18B, 18C and 18D and each metering orifice 31, 32, 33 and 34 controls fluid flow between a unique pair of ports.

FIG. 1 illustrates a zero force state of the actuator system 10. In this state, all metering orifices 31, 32, 33 and 34 of the servo valve assembly 18 are preferably completely open, or otherwise open such that fluid flow through the servo valve assembly 18 yields substantially equal pressure on each side of the piston 12. In this state, fluid flow through orifices 31 and 33 are substantially the same and if the piston 12 is stationary in the cylinder of the actuator 16, fluid flow through orifices 32 and 34 to the return 22 are also the same. In this state, actuator ports 36,38 are fluidly coupled to each other. The actuator piston 12 is free to move in either direction by any external disturbance applied to the piston 12 (indicated by double arrow 54) although there may be a slight amount of parasitic viscous damping due to fluid porting. In this state, the hydraulic pump 20 is simply pumping hydraulic fluid with no or minimal pressure through the servo valve assembly 18 to the return 22.

A controller is schematically indicated at 40 and receives a command signal 44. A transducer suitable for providing an indication of force applied by the actuator 16 is operably coupled to the actuator. In the exemplary embodiment, the transducer comprises a load cell 46 operably connected to the actuator 16 such as through a piston rod 48 to provide a signal indicative of a force generated by the actuator 16 to the controller 40. It should be noted that the load cell 46 can be operably connected to the actuator 16 in another manner such as being operably coupled to the cylinder 14. Likewise, in yet another embodiment pressure transducer(s) can be operably coupled to the actuator 16 so as to measure fluid pressure(s) on one or both sides of the piston 12. The measured pressure (s) can then be converted or used directly by the controller 40 as an indication of force generated by the actuator 16.

The controller 40 controls the switching assembly 18 (i.e. a proportional valve assembly) selectively operating the switching assembly 18 (typically by controlling movement of a metering spools) so as to cause the metering orifices 31-34, based upon the command 44, to selectively constrict, thereby inhibiting or reducing fluid flow therethrough and subsequently increasing the pressure on one side of the metering orifice 31-34.

Stated another way, the controller 40 is operably coupled to the servo assembly 18 to operate the servo actuator system in a first state and a second state, wherein in the first state the controller 40 controls each of the plurality of metering orifices 31-34 such that fluid from the pump 20 flows to the return 22 and fluid transfers freely in and out of the ports 36, 38 with an external force applied to the movable member 12, and wherein in the second state the controller 40 controls each of the plurality of metering orifices 31-34 such that fluid pressure from the pump 20 causes movement of the movable member 12 in the actuator body 14 while allowing cross flow of fluid between the ports 36, 38.

Referring to FIG. 2, a tension force state is obtained in the actuator system 10 whereby the actuator piston 12 is forced in a direction indicated by arrow 50. From the zero force state of FIG. 1, this is accomplished by controlling metering orifices 31 and 32 to constrict fluid flow therethrough while maintaining 33 and 34 in an open state (or a more open state than that of the metering orifices 31 and 32). This results in a pressure rise at the port 38 caused by constriction of the metering orifices 31 and 32, while allowing unrestricted flow from port 36 to the return 22. However, since the ports 36 and 38 still have some cross flow capability indicated by double arrow 54, the actual position of the piston 12 in the actuator cylinder 14 is indeterminate; thus; realizing a true force vector being applied by the actuator 16.

Similarly, a compression force state of the actuator system 10 is obtained by controlling metering orifices 33 and 34 to cause constriction, while maintaining metering orifices 31 and 32 in an open state (or a more open state than metering orifices 33 and 34). This realizes a pressure rise at port 36 and unrestricted flow from port 38 to reserve 22, while again maintaining actuator ports 36 and 38 with some crossflow capability. A pressure rise at port 36 causes force independent of position applied to the piston 12 in a direction indicated by arrow 56.

FIG. 3 illustrates use of two conventional servo valve assemblies 70 and 72 to realize the function of the four port servo valve assembly 18 illustrated in FIGS. 1 and 2. In the embodiment of FIG. 3, the same reference numerals have been used to identify similar components illustrated in FIGS. 1 and 2. In this embodiment, the servo valve assembly 70 comprises four metering orifices; however, the metering orifices 75 and 76 are always closed, while the other metering orifices are identified as metering orifices 33 and 34 of FIGS. 1 and 2. Similarly, the servo valve assembly 72 includes four metering orifices; however, the metering orifices 77 and 78 are always closed, while the other metering orifices are identified as metering orifices 31 and 32 of FIGS. 1 and 2. The pump 20 of FIG. 3 is fluidly coupled to the metering orifices 31 and 33 in a manner similar to the pump 20 being fluidly connected to metering orifices 31 and 33 of FIGS. 1 and 2. Similarly, the metering orifices 32 and 34 are fluidly coupled to the return 22; the port 36 is fluidly coupled to metering orifices 31 and 34; and the port 38 is fluidly coupled to metering orifices 32 and 33.

In the embodiment of FIG. 3, the conventional servo valve assemblies 70, 72 are designed so as to have the metering orifices 31-34 in an open state when a suitable control voltage is applied thereto. Hence, in order to operate the metering orifices 31-34 so as to constrict fluid flow the absolute value of the control voltages applied is reduced. For example, let it be assumed that to maintain metering orifices 33 and 34 in an open state, a voltage of +10 volts is applied, while to maintain the metering orifices 31 and 32 in an open state, a voltage of −10 volts must be applied. Constriction of fluid flow is then realized at metering orifices 33 and 34 when less than 10 volts is applied. Likewise, constriction of fluid flow is then realized at metering orifices 31 and 32 when the control voltage is increased from −10 volts toward 0.

Figure 4:
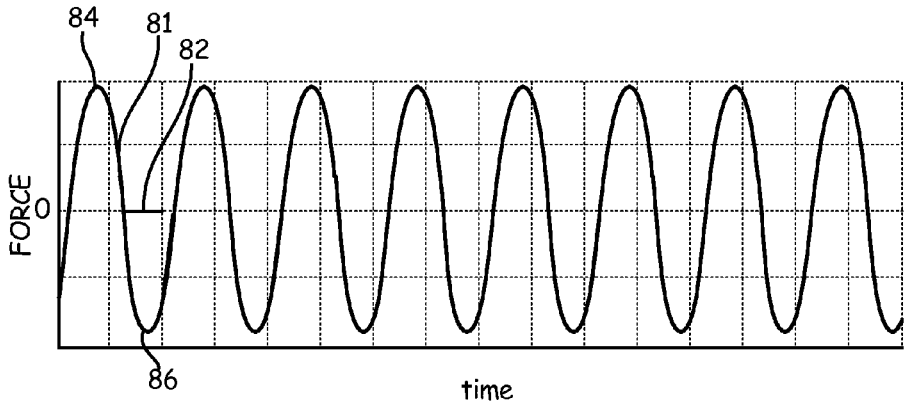
FIG. 4 is a plot of an oscillating force of an actuator.

FIG. 4 illustrates a plot of an oscillating force 81 generated by the actuator 16 where zero force is indicated at 82, a maximum compression force is indicated at 84 and a maximum tension force is indicated at 86.

Figure 5:
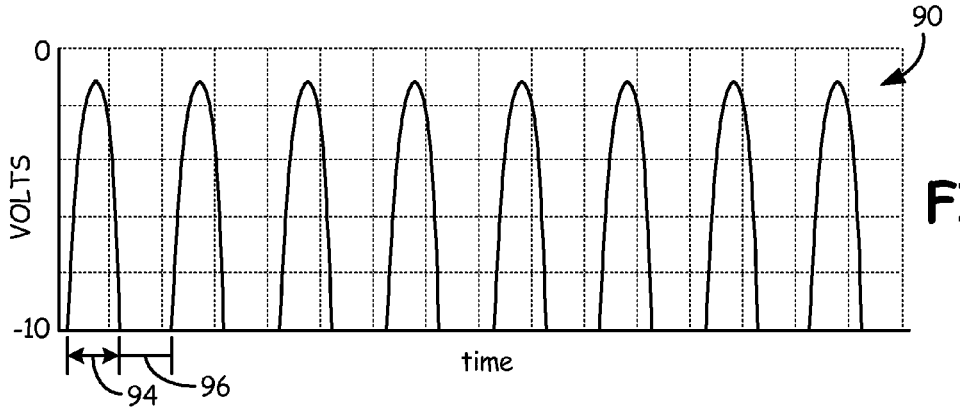
FIGS. 5 and 6 are plots of control signals for a servo assembly when realized with two conventional hydraulic servovalves.
Figure 6:
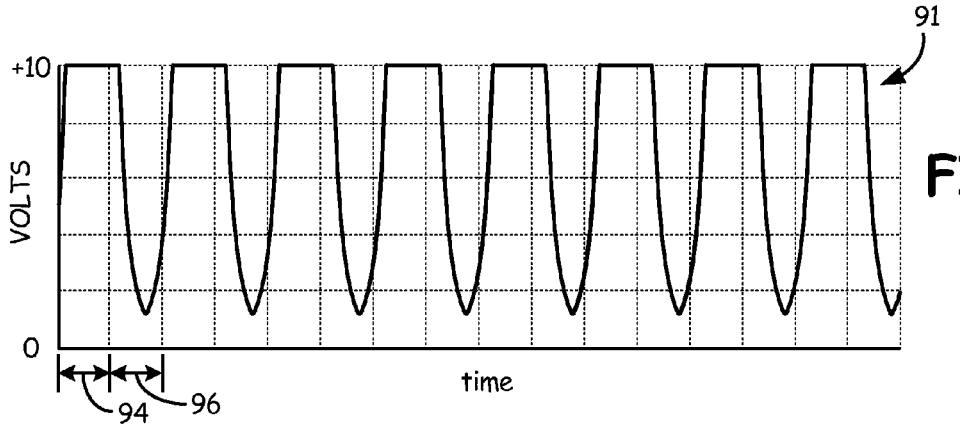

FIGS. 5 and 6 illustrate command signals 90, 91, respectively, for the servo valve assemblies 70 and 72 and in particular to metering orifices 31-34 to realize the oscillating of FIG. 4. In particular, a compression force is obtained by controlling metering orifices 31 and 32 by reducing the absolute value of the negative voltage applied thereto as illustrated in FIG. 5 during the time period 94, while at the same time metering orifices 33 and 34 are held in the open state by applying a +10 volts thereto as illustrated in FIG. 6. In a similar fashion, tension loads are generated by the actuator 16 when a control voltage to the metering orifices 31 and 32 is reduced in time period 96, while the control voltage for metering orifices 33 and 34 receive a −10 volts.

It should be noted that control signals for the metering orifices of servo valve assemblies 18, 70, 72 may need compensation in order to realize the desired force vector from the actuator 16. In particular, compensation may be needed if fluid flow through the servo valve assemblies in the fully open state exhibits turbulence while in a constricting state fluid flow is more linear. Compensation can be provided in any suitable manner such as through (look up tables, polynomial representations or the like implemented for example by the servo valve controller 40). Compensation may be embodied in hardware (analog and/or digital circuitry) and/or in software operable on a suitable computing device, such as a digital signal processor, which also is circuitry. The circuitry can further include without limitation logic arrays in a system on a chip implementation that integrates some if not all the circuitry and components of a computer or other electronic system that processes digital signals, analog signals, and/or mixed digital and analog signals on the single chip substrate.

Although the subject matter has been described in language specific to structural features and/or methodological acts, it is to be understood that the subject matter defined in the appended claims is not necessarily limited to the specific features or acts described above as has been determined by the courts. Rather, the specific features and acts described above are disclosed as example forms of implementing the claims.

What is claimed is:

1. A servo actuator system comprising:

a dual acting actuator comprising:

an actuator body;

a movable member movable in the actuator body to define a first and second chamber on each side of the movable member;

a first port fluidly coupled to the first chamber; and a second port fluidly coupled to the second chamber;

a fluid pump having a return;

a servo assembly fluidly coupled to the fluid pump, return and the first and second ports, the servo assembly having a plurality of metering orifices; and a controller operably coupled to the servo assembly to operate the servo actuator system in a first state and a second state, wherein in the first state the controller controls each of the plurality of metering orifices such that fluid from the pump flows to the return and fluid transfers freely in and out of the ports with an external force applied to the movable member, and wherein in the second state the controller controls each of the plurality of metering orifices such that fluid pressure from the pump causes a load to be applied to the movable member in the actuator body while allowing cross flow of fluid between the first and second ports.

2. The servo actuator system of claim 1 wherein the actuator comprises a linear actuator.

3. The servo actuator system of claim 1 wherein the actuator comprises a rotary actuator.

4. The servo actuator system of claim 1 wherein the controller in the second state controls a first metering orifice to inhibit fluid flow therethrough while controlling a second metering orifice to allow fluid flow therethrough at a rate greater than that of a rate through the first metering orifice.

5. The servo actuator system of claim 1 wherein the servo assembly comprises four metering orifices and four ports, wherein a unique pair of metering orifices is fluidly connected to each port and each metering orifice controls fluid flow between a unique pair of ports.

6. The servo actuator system of claim 5 wherein the controller in the second state controls a first metering orifice and a second metering orifice to inhibit fluid flow therethrough while controlling a third metering orifice and a fourth metering orifice to allow fluid flow therethrough at a rate greater than that of a rate through the first metering orifice.

7. A method of controlling an actuator system having an actuator body, a movable member movable in the actuator body to define a first and second chamber on each side of the movable member, a first port fluidly coupled to the first chamber, a second port fluidly coupled to the second chamber, a fluid pump having a return, and a servo assembly fluidly coupled to the fluid pump, return and the first and second ports, the servo assembly having a plurality of metering orifices, the method comprising:

selectively operating the actuator system in a first state and a second state, wherein the first state comprises:

controlling each of the plurality of metering orifices with a controller such that fluid from the pump flows to the return and fluid transfers freely in and out of the ports with an external force applied to the movable member; and wherein the second state comprises:

controlling each of the plurality of metering orifices with the controller such that fluid pressure from the pump causes a load to be applied to the movable member in the actuator body while allowing cross flow of fluid between the first and second ports.

8. The method of claim 7 wherein the actuator comprises a linear actuator.

9. The method of claim 8 wherein the actuator comprises a rotary actuator.

10. The method of claim 7 wherein the servo assembly comprises four metering orifices and four ports, wherein a unique pair of metering orifices is fluidly connected to each port and each metering orifice controls fluid flow between a unique pair of ports, and wherein controlling each of the metering orifices in the second state comprises:

controlling a first metering orifice and a second metering orifice to inhibit fluid flow therethrough while controlling a third metering orifice and a fourth metering orifice to allow fluid flow therethrough at a rate greater than that of a rate through the first metering orifice.

11. A servo actuator system comprising:

a dual acting actuator comprising:

an actuator body;

a movable member movable in the actuator body to define a first and second chamber on each side of the movable member;

a first port fluidly coupled to the first chamber; and a second port fluidly coupled to the second chamber;

a fluid pump having a return;

a servo assembly fluidly coupled to the fluid pump, return and the first and second ports, the servo assembly having a plurality of metering orifices; and a controller operably coupled to the servo assembly to control the plurality of metering orifices to generate a vector having magnitude and direction and wherein an actual position of a movable member in an actuator body is indeterminate while allowing cross flow of fluid between the first and second ports.

12. The servo actuator system of claim 11 wherein the actuator comprises a linear actuator and the vector comprises a force.

13. The servo actuator system of claim 11 wherein the actuator comprises a rotary actuator and the vector comprises a torque.

* * * * *